US010207833B2

(12) United States Patent
Cheng et al.

(10) Patent No.: US 10,207,833 B2
(45) Date of Patent: Feb. 19, 2019

(54) PACKAGING CONTAINER AND PACKAGING METHOD USING THE SAME

(71) Applicants: BOE TECHNOLOGY GROUP CO., LTD., Beijing (CN); HEFEI BOE OPTOELECTRONICS TECHNOLOGY CO., LTD., Anhui (CN)

(72) Inventors: Xuan Cheng, Beijing (CN); Xingguang Jin, Beijing (CN); Lei Jin, Beijing (CN); Yimin Wang, Beijing (CN); Hao Li, Beijing (CN)

(73) Assignees: BOE TECHNOLOGY GROUP CO., LTD., Beijing (CN); HEFEI BOE OPTOELECTRONICS TECHNOLOGY CO., LTD., Hefei, Anhui (CN)

( * ) Notice: Subject to any disclaimer, the term of this patent is extended or adjusted under 35 U.S.C. 154(b) by 148 days.

(21) Appl. No.: 14/748,674

(22) Filed: Jun. 24, 2015

(65) Prior Publication Data

US 2016/0130075 A1 May 12, 2016

(30) Foreign Application Priority Data

Nov. 11, 2014 (CN) ..... 2014 1 0633077

(51) Int. Cl.
*B65D 85/38* (2006.01)
*B65B 23/20* (2006.01)
(Continued)

(52) U.S. Cl.
CPC ..... *B65B 23/20* (2013.01); *B65B 7/28* (2013.01); *B65D 11/1873* (2013.01);
(Continued)

(58) Field of Classification Search
CPC .. B65D 11/1873; B65D 11/28; B65D 81/022; B65B 23/20; B65B 7/28
See application file for complete search history.

(56) References Cited

U.S. PATENT DOCUMENTS 3,410,441 A * 11/1968 Rhyne ..... A47B 88/0014 220/4.28
3,982,650 A * 9/1976 Ichihara ..... B65D 11/1833 217/12 R
(Continued)

FOREIGN PATENT DOCUMENTS

CN 201395283 Y 2/2010
CN 101734398 A 6/2010
(Continued)

OTHER PUBLICATIONS

Office Action dated Feb. 2, 2016 issued in corresponding Chinese Application No. 201410633077.2.

*Primary Examiner* — Anthony Stashick
*Assistant Examiner* — James Way
(74) *Attorney, Agent, or Firm* — Nath, Goldberg & Meyer; Joshua B. Goldberg; Scott H. Blackman

(57) ABSTRACT

The invention provides a packaging container for plate shaped articles and a packaging method using the same. The packaging container comprises a container sole plate, a container lid plate and container side plates. Each of them is provided with detachable assembling parts which allow the container sole plate, the container lid plate and container side plates to be detachably assembled to form the packaging container. The arrangement of detachable assembling parts on the container sole, the container lid and the container side plates may realize the detachable assembly among them. That is, any side of the cubic packaging container can be separately detached during the packaging operation, such that it is possible to more easily and
(Continued)

promptly package or obtain the plate shaped articles, while the plate shaped articles are hardly to be damaged when being packaged, thereby fulfilling the demand on automatic packaging for plate shaped articles.

16 Claims, 4 Drawing Sheets

(51) Int. Cl.
*B65B 7/28* (2006.01)
*B65D 6/24* (2006.01)
*B65D 6/34* (2006.01)
*B65D 81/02* (2006.01)
*B65D 85/48* (2006.01)

(52) U.S. Cl.
CPC ..... *B65D 11/28* (2013.01); *B65D 81/022* (2013.01); *B65D 85/48* (2013.01)

(56) References Cited

U.S. PATENT DOCUMENTS 4,278,196 A * 7/1981 Ford ..... A47B 88/0003 220/4.33
5,588,531 A * 12/1996 Yoshida ..... B65D 81/022 206/454
7,290,663 B2 * 11/2007 Deng ..... B65D 11/1826 206/454
7,604,121 B1 * 10/2009 Tang ..... B65D 25/06 206/454
9,363,948 B2 * 6/2016 Birkland ..... A01G 1/08
2005/0279666 A1 * 12/2005 Deng ..... B65D 25/107 206/454
2007/0194022 A1 * 8/2007 Huggett ..... B65D 13/04 220/6
2008/0264825 A1 10/2008 Hagan, III et al.
2009/0261093 A1 * 10/2009 Fullerton ..... B25H 3/021 220/4.28
2010/0018966 A1 * 1/2010 Roberts, Sr. ..... B65D 19/18 220/4.31
2013/0146606 A1 * 6/2013 Blay Orenga ..... B65D 11/1873 220/628

FOREIGN PATENT DOCUMENTS

CN 203903008 U 10/2014
CN 104129546 A 11/2014

* cited by examiner

PACKAGING CONTAINER AND PACKAGING METHOD USING THE SAME

FIELD OF THE INVENTION

The present invention relates to the field of packaging technology for Liquid Crystal Display, and in particular to a packaging container for packaging liquid crystal panel and a packaging method using the same.

BACKGROUND OF THE INVENTION

Liquid Crystal Display (LCD) has become the mainstream product of flat panel display devices due to its characteristics of less volume, lower power consumption, no radiation and the like. Liquid crystal panel is a critical component of LCD. In a process of manufacturing LCD, the liquid crystal panel is often subjected to be reciprocally used, so that the packaging and the transportation of the liquid crystal panel may be frequently concerned.

Currently, for the packaging and the transportation of the liquid crystal panel, an integral packaging container made of a polypropylene foam material has been widely used. As shown in FIG. 1, a container body 7 of the integral packaging container used for accommodating liquid crystal panels 10 is of an integral structure, wherein the liquid crystal panels 10 are perpendicularly placed into the container body 7, and an opening of the container body 7 is covered by a packaging container lid plate 8, thereby realizing the packaging for the liquid crystal panels 10. The packaging for the liquid crystal panels 10 having different sizes is usually realized by arranging slide blocks 9 having different thicknesses inside the packaging container body 7 of the integral packaging container.

The above-mentioned integral packaging container has difficulty in packaging operation and can not fulfill the demand on automatic packaging. In addition, the liquid crystal panels 10 placed in the packaging container are commonly removed by a mechanical arm. Since the removal of the liquid crystal panels 10 can be operated only at the opening of the container body 7 in addition to relatively small intervals between the liquid crystal panels 10 inside the packaging container, it is very difficult for the mechanical arm to access to the liquid crystal panels 10.

SUMMARY OF THE INVENTION

In view of the above technical problems in the prior art, an objective of the present invention is to provide a packaging container and a packaging method using the same. The arrangement of detachable assembling parts on a container sole plate, a container lid plate and container side plates of the packaging container may realize the detachable assembly among the container sole plate, the container lid plate and the container side plates. Thus it is possible to more easily and promptly package or obtain plate shaped articles, while the plate shaped articles are hardly to be damaged when being packaged, thereby fulfilling the demand on automatic packaging for the plate shaped articles.

The packaging container for packaging plate shaped articles, according to the present invention, comprises a container sole plate, a container lid plate and container side plates. Each of said container sole plate, said container lid plate and said container side plates is provided with detachable assembling parts, which allow said container sole plate, said container lid plate and said container side plates to be detachably assembled to form said packaging container.

Preferably, said container side plates comprise a first side plate, a second side plate, a third side plate and a fourth side plate, the first side plate and the second side plate being oppositely arranged, and the third side plate and the fourth side plate being oppositely arranged; and said detachable assembling parts comprise first connectors provided on four vertical end surface of said container sole plate, respectively, and also comprise second connectors provided on respective lower margins of both opposite vertical plate surfaces of said first side plate and said second side plate and on respective lower margins of both opposite vertical plate surfaces of said third side plate and said fourth side plate, said first connectors and said second connectors being detachably connected to each other, such that said first side plate, said second side plate, said third side plate and said fourth side plate are detachably connected to the four vertical end surfaces of said container sole plate.

Preferably, said detachable assembling parts further comprise third connectors provided on right and left-hand vertical end surfaces of said first side plate and said second side plate, respectively, and fourth connectors provided on right and left-hand margins of both opposite vertical plate surfaces of said third side plate and said fourth side plate, respectively; and said third connectors separately provided on the right and left-hand vertical end surfaces of said first side plate are detachably connected to respective said fourth connectors provided on left-hand margins of both opposite vertical plate surfaces of said third side plate and said fourth side plate, and said third connectors separately provided on the right and left-hand vertical end surfaces of said second side plate are detachably connected to respective said fourth connectors provided on right-hand margins of both opposite vertical plate surfaces of said third side plate and said fourth side plate, such that said first side plate, said third side plate, said second side plate and said fourth side plate are detachably connected to each other.

Preferably, said container side plates further comprise a first adjustment plate and a second adjustment plate arranged between said first side plate and said second side plate, said first adjustment plate being arranged on the side of said first side plate, said second adjustment plate being arranged on the side of said second side plate, and the distance between said first adjustment plate and said second adjustment plate being equal to width/length of said plate shaped articles; and said detachable assembling parts further comprise fifth connectors provided on horizontal lower end surfaces of said first adjustment plate and said second adjustment plate, respectively, and sixth connectors provided on both opposite margins of horizontal upper plate surface of said container sole plate, respectively, said fifth connectors and said sixth connectors being detachably connected to each other, such that said first adjustment plate and said second adjustment plate are detachably connected to the upper plate surface of said container sole plate, respectively.

Preferably, said first adjustment plate is attached to said first side plate, and said second adjustment plate is attached to said second side plate, and said detachable assembling parts further comprise seventh connectors provided on a plate surface of said first adjustment plate facing said first side plate and on a plate surface of said second adjustment plate facing said second side plate, respectively, and eighth connectors provided on a plate surface of said first side plate facing said first adjustment plate and on a plate surface of said second side plate facing said second adjustment plate, respectively, said seventh connectors and said eighth connectors being detachably connected to each other, such that said first adjustment plate and said first side plate are detachably connected to each other, and said second adjustment plate and said second side plate are detachably connected to each other.

Preferably, said detachable assembling parts further comprise ninth connectors provided on both right and left-hand vertical end surfaces of said first adjustment plate and said second adjustment plate, respectively, and tenth connectors provided on right and left-hand margins of both opposite vertical plate surfaces of said third side plate and said fourth side plate, respectively, said tenth connectors being placed closer to the inside of said third side plate and said fourth side plate with respect to said fourth connectors; and said ninth connectors separately provided on right and left-hand vertical end surfaces of said first adjustment plate are detachably connected to the tenth connectors provided on the left-hand margins of both opposite vertical plate surfaces of said third side plate and said fourth side plate, respectively, and ninth connectors separately provided on the right and left-hand vertical end surfaces of said second adjustment plate are detachably connected to said tenth connectors provided on the right-hand margins of both opposite vertical plate surfaces of said third side plate and said fourth side plate, such that said first adjustment plate and said second adjustment plate are detachably connected to said third side plate and said fourth side plate.

Preferably, said detachable assembling parts further comprise eleventh connectors provided on horizontal upper end surfaces of said first side plate, said second side plate, said third side plate and said fourth side plate, respectively, and twelfth connectors provided on periphery of lower plate surface of said container lid plate, said eleventh connectors and said twelfth connectors being detachably connected to each other, such that said container lid plate is detachably connected to said first side plate, said second side plate, said third side plate and said fourth side plate.

Preferably, each of said container sole plate, said container lid plate, said container side plates and said detachable assembling parts are made of a polypropylene plastic foam material.

Preferably, said first connectors, said third connectors, said fifth connectors, said seventh connectors, said ninth connectors and said eleventh connectors are all formed as protrusions, while said second connectors, said fourth connectors, said sixth connectors, said eighth connectors, said tenth connectors and said twelfth connectors are all formed as recesses; and the shape of said protrusions corresponds to that of said recesses, and the size of said protrusions is equal to or slightly larger than that of said recesses, such that said protrusions are able to be engaged with and disengaged from said recesses.

Preferably, said protrusions are formed in shapes of cuboid, inverted truncated pyramid or inverted truncated cone, and said recesses are formed in shapes of cuboid, inverted truncated pyramid or inverted truncated cone which are complementary to those of said protrusions.

Preferably, the packaging container further comprises a first buckle and a second buckle, and said detachable assembling parts further include first extension blocks provided on left-hand of upper margins of the plate surfaces of said first side plate and said second side plate, respectively, and second extension blocks provided on right-hand of upper margins of their plate surfaces, said first extension block and said second extension block on said first side plate extending toward said second side plate, and said first extension block and said second extension block on said second side plate extending toward said first side plate; and Each of said first buckle and said second buckle is a U-shaped groove in form of strip, the middle portion of said first buckle sleeving said eleventh connector on the horizontal upper end surface of said third side plate, and both ends of said first buckle sleeving said first extension blocks on said first side plate and said second side plate, respectively; the middle portion of said second buckle sleeving said eleventh connector on the horizontal upper end surface of said fourth side plate and both ends of said second buckle sleeving said second extension blocks on said first side plate and said second side plate, respectively.

Preferably, each of said first buckle and said second buckle is made of a stainless steel material.

Preferably, said first connectors, said third connectors, said fifth connectors, said seventh connectors, said ninth connectors and said eleventh connectors are all formed as N pole magnets, while said second connectors, said fourth connectors, said sixth connectors, said eighth connectors, said tenth connectors and said twelfth connectors are all formed as S pole magnets, such that various components are mutually connected by the attraction of the N pole magnets and the S pole magnets.

Also, the present invention further provides a packaging method using above-described packaging container, comprising steps of:

Step S1: connecting and assembling the container side plates and the container sole plate by the detachable assembling parts, such that an opening is formed by the assembled container side plates;

Step S2: placing the plate shaped articles into the packaging container assembled at Step S1 from the opening; and Step S3: capping the opening of the packaging container, where the plate shaped articles are accommodated, with the container lid plate by using the detachable assembling parts.

The present invention has following advantages: in the packaging container according to the present invention, the detachable assembling parts are provided on the container sole plate, the container lid plate and the container side plates, such that any two of adjacent container sole plate, container lid plate and container side plates of the packaging container can be separately assembled and detached. In this manner, it is possible to more easily and promptly package plate shaped articles, while the plate shaped articles are hardly to be damaged when being packaged, thereby fulfilling the demand on automatic packaging for the plate shaped articles.

The packaging method using above-described packaging container according to the present invention may allow to more easily and promptly package the plate shaped articles, while the plate shaped articles are hardly to be damaged when being packaged, thereby fulfilling the demand on automatic packaging for the plate shaped articles.

IN THE NUMERAL REFERENCES

Figure 1:
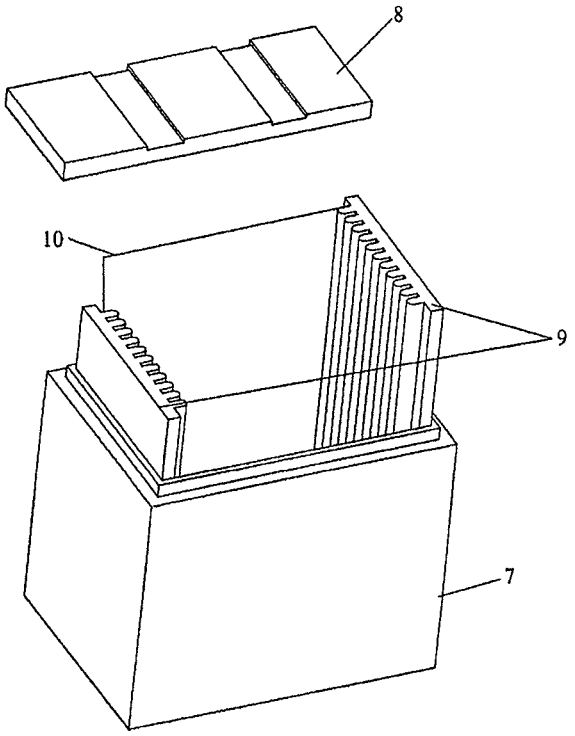
Fig. 1 (Prior Art)
FIG. 1 is a schematic diagram showing a structure of a packaging container in the prior art.

1—container sole plate; 2—container lid plate; 3—container side plate; 31—first side plate; 32—second side plate; 33—third side plate; 34—fourth side plate; 35—first adjustment plate; 36—second adjustment plate; 41—first connector; 42—second connector; 43—third connector; 44—fourth connector; 45—fifth connector; 46—sixth connector; 47—seventh connector; 48—eighth connector; 49—ninth connector; 40—tenth connector; 50—eleventh connector; 51—twelfth connector; 5—first buckle; 6—second buckle; 301—first extension block; 302—second extension block; 7—container body; 8—lid plate; 9—slide block; and 10—liquid crystal panel.

DETAILED DESCRIPTION OF THE EMBODIMENTS

To make those skilled in the art better understand the technical solutions of the present invention, a packaging container and a packaging method using the same provided by the present invention will be further described below in detail in connection with the accompanying drawings and specific embodiments.

First Embodiment

According to the first embodiment of the present invention, there is provided a packaging container for packaging plate shaped articles. As shown in FIGS. 2-7, the packaging container according to this embodiment may include a container sole plate 1, a container lid plate 2 and container side plates 3. The container sole plate 1, the container lid plate 2 and the container side plates 3 may be assembled as a cubic shaped packaging container. Detachable assembling parts are provided on each of the container sole plate 1, the container lid plate 2 and the container side plates 3. The detachable assembling parts may allow the container sole plate 1, the container lid plate 2 and the container side plates 3 to be detachably assembled.

The plate shaped article in this embodiment may be a liquid crystal panel 10. The arrangement of the detachable assembling parts may realize the detachable assembly among the container sole plate 1, the container lid plate 2 and the container side plates 3 of the packaging container. That is, any side of the packaging container can be separately detached during a packaging operation, such that it is possible to more easily and promptly package or obtain the liquid crystal panels 10, while the liquid crystal panels 10 are hardly to be damaged when being packaged, thereby fulfilling the demand on automatic packaging for the liquid crystal panels 10.

Figure 2:
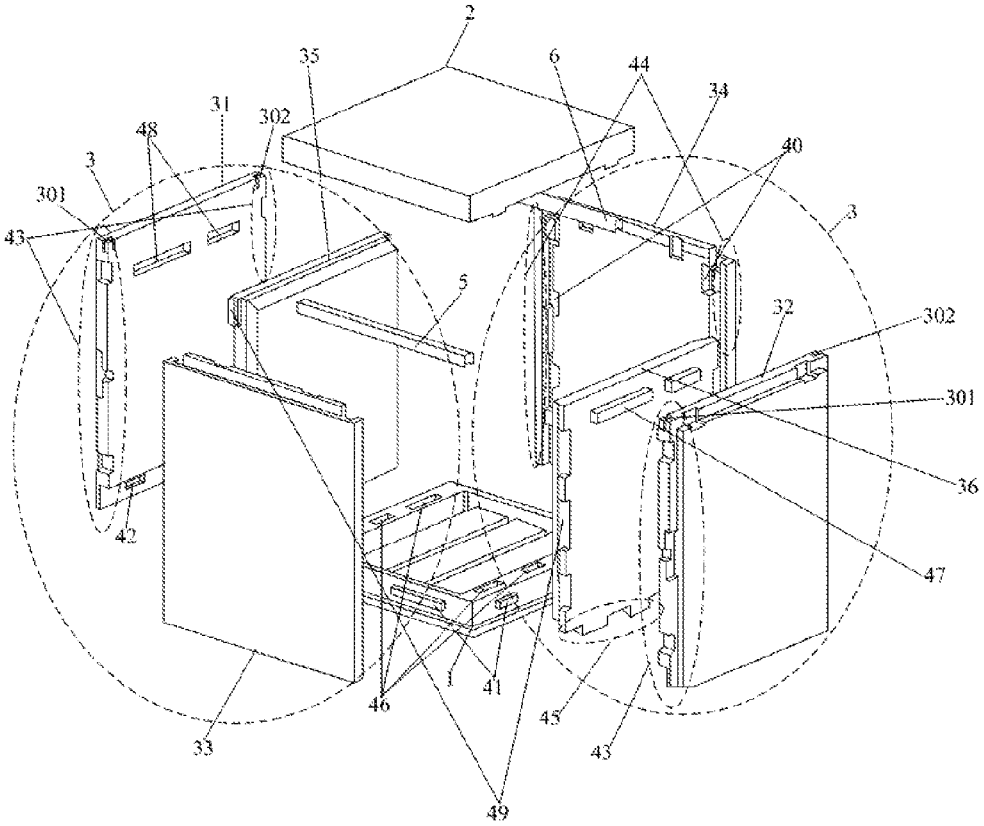
FIG. 2 is an exploded diagram showing a structure of a packaging container according to a first embodiment of the present invention.
Figure 5:
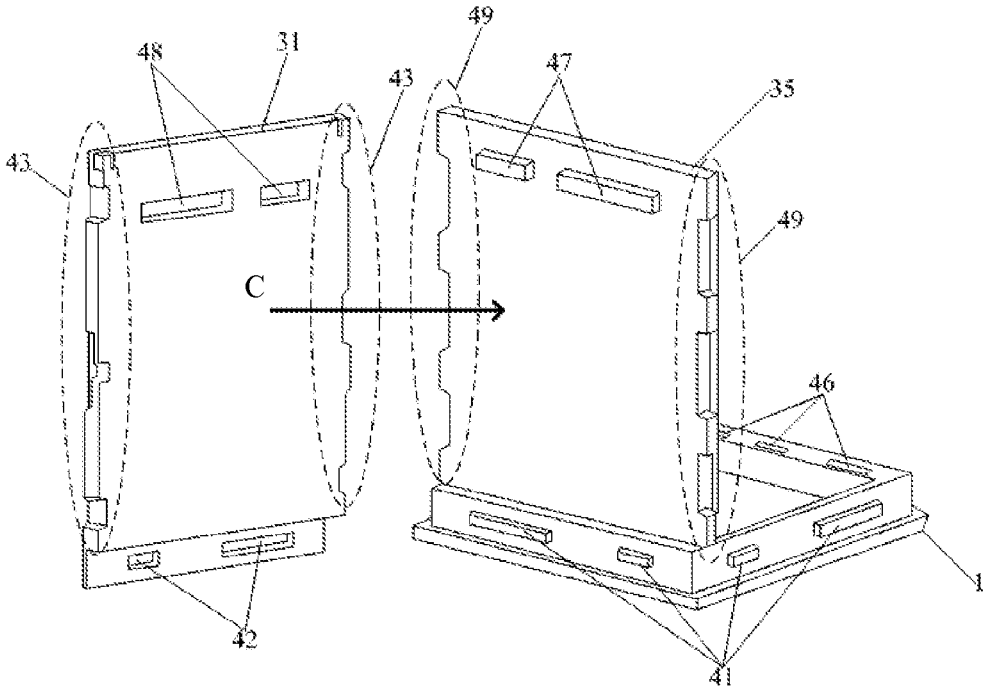
FIG. 5 is a schematic diagram showing an assembly of a first side plate and the first adjustment plate in FIG. 2.

In this embodiment, the container side plates 3 may comprise a first side plate 31, a second side plate 32, a third side plate 33 and a fourth side plate 34. The first side plate 31 and the second side plate 32 are oppositely arranged, and the third side plate 33 and the fourth side plate 34 are oppositely arranged. As shown in FIGS. 2 and 5, the detachable assembling parts may comprise first connectors 41 provided on four vertical end surfaces of the container sole plate 1, respectively, and also comprise second connectors 42 provided on respective lower margins of both opposite vertical plate surfaces of the first side plate 31 and the second side plate 32 and on respective lower margins of both opposite vertical plate surfaces of the third side plate 33 and the fourth side plate 34. The first connectors 41 and the second connectors 42 may be detachably connected to each other, such that the first side plate 31, the second side plate 32, the third side plate 33 and the fourth side plate 34 may be detachably connected to the four vertical end surfaces of the container sole plate 1, respectively.

Therefore, the first connectors 41 and the second connectors 42 may be used to detachably connect the first side plate 31, the second side plate 32, the third side plate 33 and the fourth side plate 34 to the container sole plate 1.

Figure 3:
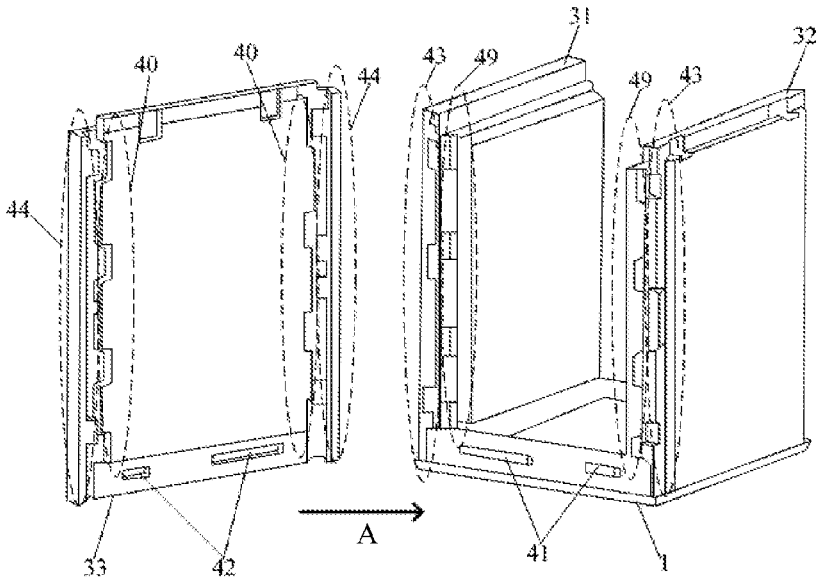
FIG. 3 is a schematic diagram showing an assembly of a container sole plate and container side plates of the packaging container in FIG. 2.

In this embodiment, as shown in FIG. 3, the detachable assembling parts may further comprise third connectors 43 provided on right and left-hand vertical end surfaces of the first side plate 31 and the second side plate 32, respectively, and fourth connectors 44 provided on right and left-hand margins of both opposite vertical plate surfaces of the third side plate 33 and the fourth side plate 34, respectively. The third connectors 43 separately provided on the right and left-hand vertical end surfaces of the first side plate 31 may be detachably connected to the respective fourth connectors 44 provided on left-hand margins of both opposite vertical plate surfaces of the third side plate 33 and the fourth side plate 34, and the third connectors 43 separately provided on the right and left-hand vertical end surfaces of the second side plate 32 may be detachably connected to the respective fourth connectors 44 provided on right-hand margins of both opposite vertical plate surfaces of the third side plate 33 and the fourth side plate 34, such that the first side plate 31, the third side plate 33, the second side plate 32 and the fourth side plate 34 may be detachably connected to each other.

As indicated by an arrow A in FIG. 3, the third connectors 43 and the fourth connectors 44 may be used to detachably connect the first side plate 31, the third side plate 33, the second side plate 32 and the fourth side plate 34 to each other.

Figure 4:
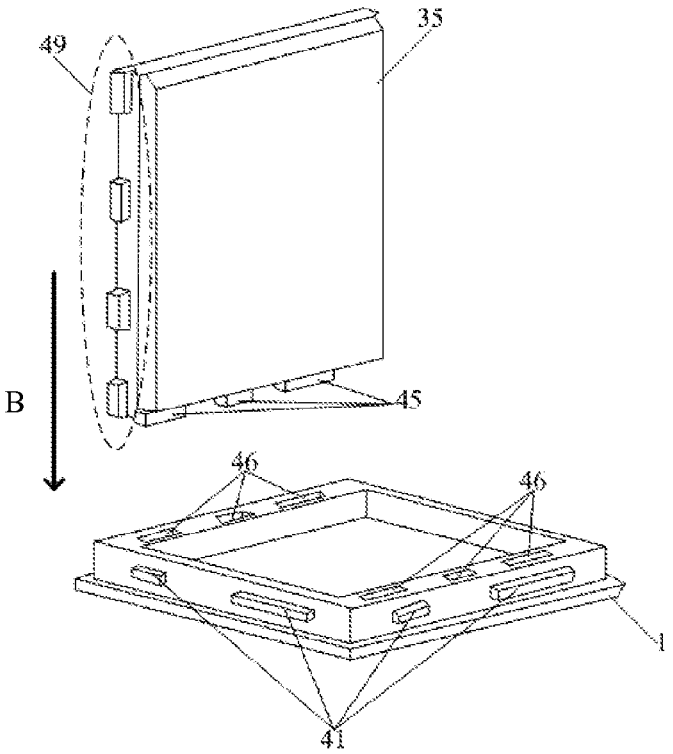
FIG. 4 is a schematic diagram showing an assembly of a first adjustment plate and the container sole plate in FIG. 2.

In this embodiment, the container side plates 3 may further comprise a first adjustment plate 35 and a second adjustment plate 36 arranged between the first side plate 31 and the second side plate 32. The first adjustment plate 35 is arranged on the side of the first side plate 31, and the second adjustment plate 36 is arranged on the side of the second side plate 32. The distance between the first adjustment plate 35 and the second adjustment plate 36 is equal to width/length of the plate shaped article. As shown in FIG. 4, the detachable assembling parts may further comprise fifth connectors 45 provided on horizontal lower end surfaces of the first adjustment plate 35 and the second adjustment plate 36, respectively, and sixth connectors 46 provided on both opposite margins of horizontal upper plate surface of the container sole plate 1, respectively. As indicated by an arrow B in FIG. 4, the fifth connectors 45 and the sixth connectors 46 may be detachably connected to each other, such that the first adjustment plate 35 and the second adjustment plate 36 may be detachably connected to the upper plate surface of the container sole plate 1.

Since the first adjustment plate 35 and the second adjustment plate 36 may be detachably connected to the container sole plate 1, respectively, by the fifth connectors 45 and the sixth connectors 46, and at the same time, the thickness of the first adjustment plate 35 and the second adjustment plate 36 may be selected according to width/length of the liquid crystal panels 10 to be enclosed in the packaging container, the packaging container is allowed to enclose the liquid crystal panels 10 having various width/length by selecting the first adjustment plate 35 and the second adjustment plate 36. The provision of the fifth connectors 45 and the sixth connectors 46 may greatly facilitate the selection and the assembly of the first adjustment plate 35 and the second adjustment plate 36 having different thickness.

In this embodiment, the first adjustment plate 35 is attached to the first side plate 31, and the second adjustment plate 36 is attached to the second side plate 32. As shown in FIG. 5, the detachable assembling parts may further comprise seventh connectors 47 provided on a plate surface of the first adjustment plate 35 facing the first side plate 31 and on a plate surface of the second adjustment plate 36 facing the second side plate 32, respectively, and eighth connectors 48 provided on a plate surface of the first side plate 31 facing the first adjustment plate 35 and on a plate surface of the second side plate 32 facing the second adjustment plate 36, respectively. As indicated by an arrow C in FIG. 5, the seventh connectors 47 and the eighth connectors 48 may be detachably connected to each other, such that the first adjustment plate 35 and the first side plate 31 are detachably connected, and the second adjustment plate 36 and the second side plate 32 are detachably connected.

The seventh connectors 47 and the eighth connectors 48 may be used to assemble and connect the first adjustment plate 35 to the first side plate 31 and to assemble and connect the second adjustment plate 36 to the second side plate 32, so as to further enhance the strength of the oppositely arranged first side plate 31 and second side plate 32 and to more firmly secure widthwise/lengthwise sides of the liquid crystal panels 10.

As shown in FIGS. 3-5, the detachable assembling parts may further comprise ninth connectors 49 provided on both right and left-hand vertical end surfaces of the first adjustment plate 35 and the second adjustment plate 36, respectively, and tenth connectors 40 provided on right and left-hand margins of both opposite vertical plate surfaces of the third side plate 33 and the fourth side plate 34, respectively. The tenth connectors 40 are arranged farther away from the right and left-hand margins of vertical plate surfaces of the third side plate 33 and the fourth side plate 34 than the fourth connectors 44. That is, the tenth connectors 40 are placed closer to the inside of the third side plate 33 and the fourth side plate 34 with respect to the fourth connectors 44.

The ninth connectors 49 separately provided on right and left-hand vertical end surfaces of the first adjustment plate 35 may be detachably connected to the tenth connectors 40 provided on the left-hand margins of both opposite vertical plate surfaces of the third side plate 33 and the fourth side plate 34, respectively, and the ninth connectors 49 separately provided on the right and left-hand vertical end surfaces of the second adjustment plate 36 may be detachably connected to the tenth connectors 40 provided on the right-hand margins of both opposite vertical plate surfaces of the third side plate 33 and the fourth side plate 34, such that the first adjustment plate 35 and the second adjustment plate 36 may be detachably connected to the third side plate 33 and the fourth side plate 34.

Figure 6:
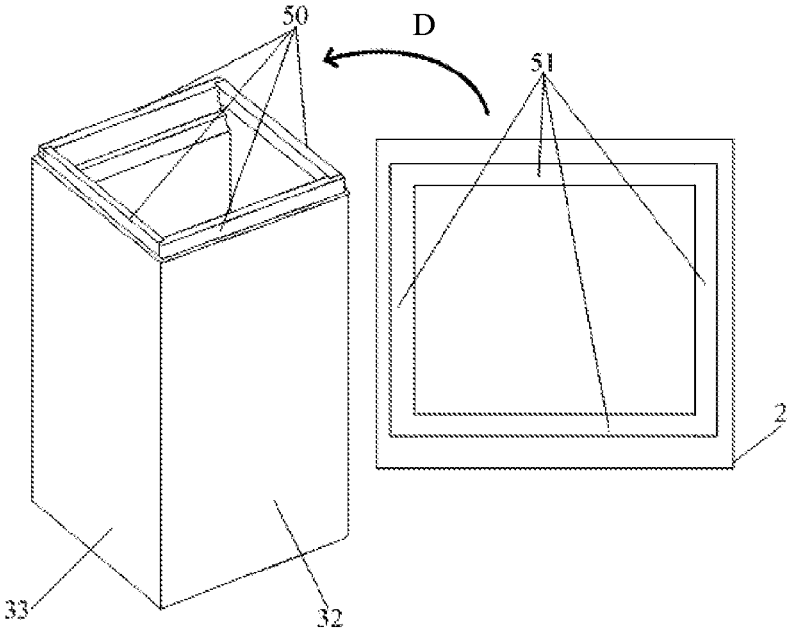
FIG. 6 is a schematic diagram showing an assembly structure of a container lid plate and the container side plates in FIG. 2.
Figure 7:
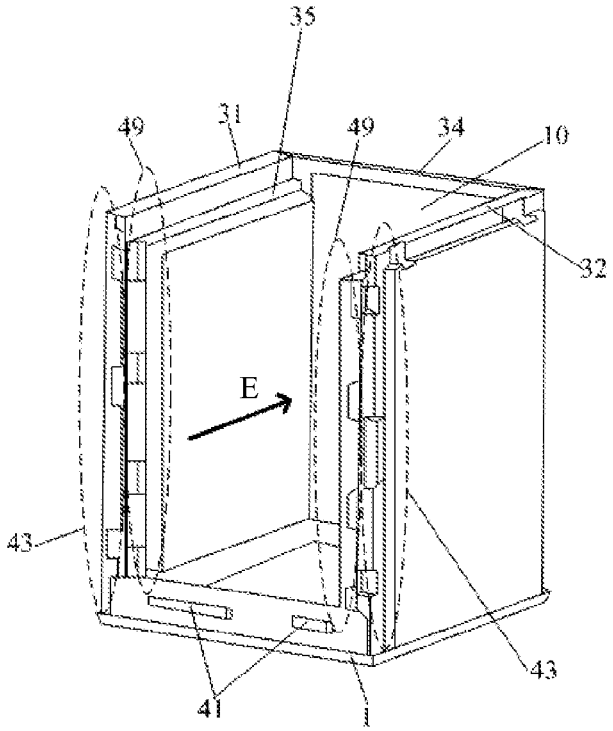
FIG. 7 is a schematic diagram showing removal of the liquid crystal panels from the packaging container in FIG. 2.

In this embodiment, as shown in FIG. 6, the detachable assembling parts may further comprise eleventh connectors 50 provided on horizontal upper end surfaces of the first side plate 31, the second side plate 32, the third side plate 33 and the fourth side plate 34, respectively, and twelfth connectors 51 provided on periphery of lower plate surface of the container lid plate 2. As indicated by an arrow D in FIG. 6, the eleventh connectors 50 and the twelfth connectors 51 may be detachably connected to each other, such that the container lid plate 2 may be detachably connected to the first side plate 31, the second side plate 32, the third side plate 33 and the fourth side plate 34.

Therefore, the eleventh connectors 50 and the twelfth connectors 51 may be used to detachably connect the first side plate 31, the second side plate 32, the third side plate 33 and the fourth side plate 34 to the container lid plate 2.

In this embodiment, each of the container sole plate 1, the container lid plate 2, the container side plates 3 and the detachable assembling parts may be made of a polypropylene plastic foam material.

In this embodiment, the first connectors 41, the third connectors 43, the fifth connectors 45, the seventh connectors 47, the ninth connectors 49 and the eleventh connectors 50 are all formed as protrusions, while the second connectors 42, the fourth connectors 44, the sixth connectors 46, the eighth connectors 48, the tenth connectors 40 and the twelfth connectors 51 are all formed as recesses. The shape of the protrusions corresponds to that of the recesses and the size of the protrusions is equal to or slightly larger than that of the recesses, in such a manner that the protrusions can be engaged with and disengaged from the recesses. The assembly and the disassembly among various components of the packaging container may be achieved by the engagement and the disengagement between the protrusions and the recesses. Therefore, according to the embodiment of the present invention, not only can the packaging container be easily and promptly assembled by components, but the assembled packaging container is firm and durable, thereby fulfilling the demand on the automatic packaging for the liquid crystal panels 10 and also improving the efficiency of automatically packaging liquid crystal panels 10.

Since the polypropylene plastic foam material has a certain elasticity, interference-fit (which means that the size of the protrusions is slightly larger than that of the recesses) may be achieved between the protrusions and the recesses made of the polypropylene plastic foam material. The interference-fit may allow for an improved firm engagement between the protrusions and the recesses. Thus the packaging container formed by assembling and connecting detachable assembling parts may be much more firm, such that it is possible to more reliably protect the liquid crystal panels 10. Therefore, the packaging container according to this embodiment can guarantee that the liquid crystal panels 10 within the packaging container are not subjected to impact and damage during the packaging and the transportation.

In this embodiment, the protrusions and the recesses are all in shapes of cuboid. It should be understood, the protrusions and the recesses may be in shapes of inverted truncated pyramid or inverted truncated cone. An improved firm snap-fit could be formed between the protrusions and the recesses in shapes of the inverted truncated pyramid or the inverted truncated cone, such that the assembled packaging container may become firmer.

In this embodiment, as shown in FIG. 2, the packaging container may further comprise a first buckle 5 and a second buckle 6. The detachable assembling parts may further comprise first extension blocks 301 provided on left-hand of upper margins of the plate surfaces of the first side plate 31 and the second side plate 32, respectively, and second extension blocks 302 provided on right-hand of upper margins of their plate surfaces. The first extension block 301 and the second extension block 302 on the first side plate 31 extends toward the second side plate 32, and the first extension block 301 and the second extension block 302 on the second side plate 32 extends toward the first side plate 31.

Each of the first buckle 5 and the second buckle 6 is a U-shaped groove in form of strip. The middle portion of the first buckle 5 sleeves the eleventh connector 50 on the horizontal upper end surface of the third side plate 33, and both ends of the first buckle 5 sleeve the first extension blocks 301 on the first side plate 31 and the second side plate 32, respectively; the middle portion of the second buckle 6 sleeves the eleventh connector 50 on the horizontal upper end surface of the fourth side plate 34, and both ends of the second buckle 6 sleeve the second extension blocks 302 on the first side plate 31 and the second side plate 32, respectively.

The first buckle 5 may be used to further reliably secure the mutually assembled first side plate 31 and second side plate 32 to the third side plate 33, preventing the disengagement of the third side plate 33 from the first side plate 31 and the second side plate 32 under external forces (for example, breaking off the third side plate 33 towards the outside of the packaging container or exerting a pushing force outwardly of the packaging container on the third side plate 33 by the liquid crystal panels 10 inside the packaging container). The second buckle 6 may be used to further reliably secure the mutually assembled first side plate 31 and second side plate 32 to the fourth side plate 34, preventing the disengagement of the fourth side plate 34 from the first side plate 31 and the second side plate 32 under external forces (for example, breaking off the fourth side plate 34 towards the outside of the packaging container or exerting a pushing force outwardly of the packaging container on the fourth side plate 34 by the liquid crystal panels 10 inside the packaging container). In such a manner, a reliable connection and assembly among the first side plate 31, the second side plate 32, third side plate 33 and the fourth side plate 34 may be ensured.

Each of the first buckle 5 and the second buckle 6 is made of a stainless steel material having rigidity. Since the first buckle 5 and the second buckle 6 of the stainless steel material each have a certain strength, it is possible to prevent the disengagement of the first side plate 31, the second side plate 32, the third side plate 33 and the fourth side plate 34, which are connected by the first buckle 5 and the second buckle 6, under the external forces, thereby ensuring the firmness and the reliability of the entire packaging container.

According to this embodiment, when liquid crystal panels 10 are obtained from the packaging container by a mechanical arm, the container lid plate 2 is first removed, then the first buckle 5 or the second buckle 6 is detached, and next the third side plate 33 or the fourth side plate 34 is detached. The mechanical arm may enter the packaging container from the side of the detached third side plate 33 or fourth side plate 34 along an arrow E in FIG. 7, and obtain the liquid crystal panels 10 inside packaging container. In such a manner, not only can a sufficient operation space be set apart for the mechanical arm, but the mechanical arm can stably hold the liquid crystal panels 10. Thus, the liquid crystal panels 10 may be much more easily obtained while being hardly to be damaged.

Based on above structure of the packaging container, this embodiment further provides a packaging method using the packaging container, which may comprise steps of:

Step S1: connecting and assembling the container side plates and the container sole plate by the detachable assembling parts, such that an opening is formed by the assembled container side plates;

Step S2: placing the plate shaped articles (in this embodiment, the liquid crystal panels) into the packaging container assembled at Step S1 from the opening; and Step S3: capping the opening of the packaging container, where the plate shaped articles are accommodated, with the container lid plate by using the detachable assembling parts.

This packaging method may allow to more easily and promptly package the liquid crystal panels, while the liquid crystal panels are hardly to be damaged when being packaged, thereby fulfilling the demand on automatic packaging for the liquid crystal panels.

Second Embodiment

The second embodiment according to the present invention provides a packaging container. The difference from the first embodiment resides in that, the first connectors, the third connectors, the fifth connectors, the seventh connectors, the ninth connectors and the eleventh connectors are all formed as N pole magnets, while the second connectors, the fourth connectors, the sixth connectors, the eighth connectors, the tenth connectors and the twelfth connectors are all formed as S pole magnets. Various components are mutually connected by the attraction of the N pole magnets and S pole magnets.

As a matter of course, it may be easily appreciated that, the first connectors, the third connectors, the fifth connectors, the seventh connectors, the ninth connectors and the eleventh connectors may be formed as S pole magnets, while the second connectors, the fourth connectors, the sixth connectors, the eighth connectors, the tenth connectors and the twelfth connector may be formed as N pole magnets, as long as the respective connectors are able to be mutually connected.

Compared to the first embodiment, in this embodiment the first buckle and the second buckle may be omitted, as long as the magnetic attraction between the N pole magnets and the S pole magnets is sufficient strong such that the container side plates, the container sole plate and the container lid plate are firmly assembled.

Other structure and materials of the packaging container in this embodiment and the packaging method using the packaging container are all the same as those in the first embodiment, the detailed description of which will be omitted herein.

In this embodiment, the detachable assembly among the container sole plate, the container lid plate and the container side plates of the packaging container may be achieved by means of the magnetic attraction, such that it is possible to more easily and promptly assemble and detach the packaging container, thereby fulfilling the demand on automatic packaging for the liquid crystal panels.

The first and second embodiments have the following advantages. In the packaging container according to the first and second embodiments, the detachable assembling parts are provided on the container sole plate, the container lid plate and the container side plates, such that any two of adjacent container sole plate, container lid plate and container side plates of the packaging container can be separately assembled and detached. In this manner, it is possible to more easily and promptly package plate shaped articles, while the plate shaped articles are hardly to be damaged when being packaged, thereby fulfilling the demand on automatic packaging for the plate shaped articles.

It should be noticed, directional terms which may be used herein such as “front”, “rear”, “left”, “right”, “front side”, “rear side”, “left-hand”, and “right-hand” all refer to relative directions when a reader observes the accompanying drawings. Therefore, these directional terms are merely for the illustrative purpose and should not be interpreted as limiting of the invention in the specification.

It should be understood that the above embodiments are merely exemplary embodiments for the purpose of illustrating the principle of the present invention, and the present invention is not limited thereto. Various modifications and improvements can be made by a person having ordinary skill in the art without departing from the spirit and essence of the present invention. Accordingly, these modifications and improvements also fall into the protection scope of the present invention.

The invention claimed is:

1. A packaging container for packaging plate shaped articles, comprising a container sole plate, a container lid plate and container side plates, wherein each of said container sole plate, said container lid plate and said container side plates is provided with detachable assembling parts, which allow said container sole plate, said container lid plate and said container side plates to be detachably assembled to form said packaging container;

said container side plates comprise a first side plate, a second side plate, a third side plate and a fourth side plate, the first side plate and the second side plate being oppositely arranged, and the third side plate and the fourth side plate being oppositely arranged;

said container side plates further comprise a first adjustment plate and a second adjustment plate arranged between said first side plate and said second side plate;

said first adjustment plate is attached to said first side plate, and said second adjustment plate is attached to said second side plate;

said first adjustment plate being arranged on the side of said first side plate, said second adjustment plate being arranged on the side of said second side plate, and the distance between said first adjustment plate and said second adjustment plate being equal to width/length of said plate shaped articles;

said detachable assembling parts further comprise fifth connectors providing protrusions on horizontal lower end surfaces of said first adjustment plate and said second adjustment plate, respectively, and sixth connectors providing corresponding recesses on both opposite margins of horizontal upper plate surface of said container sole plate, respectively, said fifth connectors and said sixth connectors being detachably connected to each other, such that said first adjustment plate and said second adjustment plate are detachably connected to the upper plate surface of said container sole plate;

and said detachable assembling parts further comprise seventh connectors provided on a plate surface of said first adjustment plate facing said first side plate and on a plate surface of said second adjustment plate facing said second side plate, respectively, and eighth connectors provided on a plate surface of said first side plate facing said first adjustment plate and on a plate surface of said second side plate facing said second adjustment plate, respectively, said seventh connectors and said eighth connectors being detachably connected to each other, such that said first adjustment plate and said first side plate are detachably connected to each other, and said second adjustment plate and said second side plate are detachably connected to each other.

2. The packaging container according to claim 1, wherein said detachable assembling parts comprise first connectors provided on four vertical end surfaces of said container sole plate, respectively, and also comprise second connectors provided on respective lower margins of both opposite vertical plate surfaces of said first side plate and said second side plate and on respective lower margins of both opposite vertical plate surfaces of said third side plate and said fourth side plate, said first connectors and said second connectors being detachably connected to each other, such that said first side plate, said second side plate, said third side plate and said fourth side plate are detachably connected to the four vertical end surfaces of said container sole plate.

3. The packaging container according to claim 2, wherein said detachable assembling parts further comprise third connectors provided on right and left-hand vertical end surfaces of said first side plate and said second side plate, respectively, and fourth connectors provided on right and left-hand margins of both opposite vertical plate surfaces of said third side plate and said fourth side plate, respectively; and said third connectors separately provided on the right and left-hand vertical end surfaces of said first side plate are detachably connected to respective said fourth connectors provided on left-hand margins of both opposite vertical plate surfaces of said third side plate and said fourth side plate, and said third connectors separately provided on the right and left-hand vertical end surfaces of said second side plate are detachably connected to respective said fourth connectors provided on right-hand margins of both opposite vertical plate surfaces of said third side plate and said fourth side plate, such that said first side plate, said third side plate, said second side plate and said fourth side plate are detachably connected to each other.

4. The packaging container according to claim 3, wherein said detachable assembling parts further comprise ninth connectors provided on both right and left-hand vertical end surfaces of said first adjustment plate and said second adjustment plate, respectively, and tenth connectors provided on right and left-hand margins of both opposite vertical plate surfaces of said third side plate and said fourth side plate, respectively, said tenth connectors being placed closer to the inside of said third side plate and said fourth side plate with respect to said fourth connectors; and said ninth connectors separately provided on right and left-hand vertical end surfaces of said first adjustment plate are detachably connected to the tenth connectors provided on the left-hand margins of both opposite vertical plate surfaces of said third side plate and said fourth side plate, respectively, and ninth connectors separately provided on the right and left-hand vertical end surfaces of said second adjustment plate are detachably connected to said tenth connectors provided on the right-hand margins of both opposite vertical plate surfaces of said third side plate and said fourth side plate, respectively, such that said first adjustment plate and said second adjustment plate are detachably connected to said third side plate and said fourth side plate.

5. The packaging container according to claim 4, wherein said detachable assembling parts further comprise eleventh connectors provided on horizontal upper end surfaces of said first side plate, said second side plate, said third side plate and said fourth side plate, respectively, and twelfth connectors provided on periphery of lower plate surface of said container lid plate, said eleventh connectors and said twelfth connectors being detachably connected to each other, such that said container lid plate is detachably connected to said first side plate, said second side plate, said third side plate and said fourth side plate.

6. The packaging container according to claim 5, wherein each of said container sole plate, said container lid plate, said container side plates and said detachable assembling parts are made of a polypropylene plastic foam material.

7. The packaging container according to claim 6, wherein said first connectors, said third connectors, said fifth connectors, said seventh connectors, said ninth connectors and said eleventh connectors are all formed as protrusions, while said second connectors, said fourth connectors, said sixth connectors, said eighth connectors, said tenth connectors and said twelfth connectors are all formed as recesses; and the shape of said protrusions corresponds to that of said recesses, and the size of said protrusions is equal to or slightly larger than that of said recesses, such that said protrusions are able to be engaged with and disengaged from said recesses.

8. The packaging container according to claim 7, wherein said protrusions are formed in shapes of cuboid, inverted truncated pyramid or inverted truncated cone, and said recesses are formed in shapes of cuboid, inverted truncated pyramid or inverted truncated cone which are complementary to those of said protrusions.

9. The packaging container according to claim 8, wherein the packaging container further comprises a first buckle and a second buckle, and said detachable assembling parts further include first extension blocks provided on left-hand of upper margins of the plate surfaces of said first side plate and said second side plate, respectively, and second extension blocks provided on right-hand of upper margins of their plate surfaces, said first extension block and said second extension block on said first side plate extending toward said second side plate, and said first extension block and said second extension block on said second side plate extending toward said first side plate; and each of said first buckle and said second buckle is a U-shaped groove in form of strip, the middle portion of said first buckle sleeving said eleventh connector on the horizontal upper end surface of said third side plate, and both ends of said first buckle sleeving said first extension blocks on said first side plate and said second side plate, respectively; the middle portion of said second buckle sleeving said eleventh connector on the horizontal upper end surface of said fourth side plate and both ends of said second buckle sleeving said second extension blocks on said first side plate and said second side plate, respectively.

10. The packaging container according to claim 9, wherein each of said first buckle and said second buckle is made of a stainless steel material.

11. The packaging container according to claim 5, wherein said first connectors, said third connectors, said fifth connectors, said seventh connectors, said ninth connectors and said eleventh connectors are all formed as N pole magnets, while said second connectors, said fourth connectors, said sixth connectors, said eighth connectors, said tenth connectors and said twelfth connectors are all formed as S pole magnets, such that various components are mutually connected by the attraction of the N pole magnets and the S pole magnets.

12. A packaging method using the packaging container according to claim 1, wherein said method comprises steps of:

Step S1: connecting and assembling the container side plates and the container sole plate by the detachable assembling parts, such that an opening is formed by the assembled container side plates;

Step S2: placing the plate shaped articles into the packaging container assembled at Step S1 from the opening; and Step S3: capping the opening of the packaging container, where the plate shaped articles are accommodated, with the container lid plate by using the detachable assembling parts.

13. The packaging method according to claim 12, wherein said detachable assembling parts comprise first connectors provided on four vertical end surfaces of said container sole plate, respectively, and also comprise second connectors provided on respective lower margins of both opposite vertical plate surfaces of said first side plate and said second side plate and on respective lower margins of both opposite vertical plate surfaces of said third side plate and said fourth side plate, said first connectors and said second connectors being detachably connected to each other, such that said first side plate, said second side plate, said third side plate and said fourth side plate are detachably connected to the four vertical end surfaces of said container sole plate.

14. The packaging method according to claim 13, wherein said detachable assembling parts further comprise third connectors provided on right and left-hand vertical end surfaces of said first side plate and said second side plate, respectively, and fourth connectors provided on right and left-hand margins of both opposite vertical plate surfaces of said third side plate and said fourth side plate, respectively; and said third connectors separately provided on the right and left-hand vertical end surfaces of said first side plate are detachably connected to respective said fourth connectors provided on left-hand margins of both opposite vertical plate surfaces of said third side plate and said fourth side plate, and said third connectors separately provided on the right and left-hand vertical end surfaces of said second side plate are detachably connected to respective said fourth connectors provided on right-hand margins of both opposite vertical plate surfaces of said third side plate and said fourth side plate, such that said first side plate, said third side plate, said second side plate and said fourth side plate are detachably connected to each other.

15. The packaging method according to claim 14, wherein said detachable assembling parts further comprise ninth connectors provided on both right and left-hand vertical end surfaces of said first adjustment plate and said second adjustment plate, respectively, and tenth connectors provided on right and left-hand margins of both opposite vertical plate surfaces of said third side plate and said fourth side plate, respectively, said tenth connectors being placed closer to the inside of said third side plate and said fourth side plate with respect to said fourth connectors; and said ninth connectors separately provided on right and left-hand vertical end surfaces of said first adjustment plate are detachably connected to the tenth connectors provided on the left-hand margins of both opposite vertical plate surfaces of said third side plate and said fourth side plate, respectively, and ninth connectors separately provided on the right and left-hand vertical end surfaces of said second adjustment plate are detachably connected to said tenth connectors provided on the right-hand margins of both opposite vertical plate surfaces of said third side plate and said fourth side plate, respectively, such that said first adjustment plate and said second adjustment plate are detachably connected to said third side plate and said fourth side plate.

16. The packaging method according to claim 15, wherein said detachable assembling parts further comprise eleventh connectors provided on horizontal upper end surfaces of said first side plate, said second side plate, said third side plate and said fourth side plate, respectively, and twelfth connectors provided on periphery of lower plate surface of said container lid plate, said eleventh connectors and said twelfth connectors being detachably connected to each other, such that said container lid plate is detachably connected to said first side plate, said second side plate, said third side plate and said fourth side plate.

* * * * *